United States Patent [19]

Bergen

[11] 4,282,303

[45] Aug. 4, 1981

[54] DEVELOPMENT METHOD AND APPARATUS

[75] Inventor: Richard F. Bergen, Ontario, N.Y.

[73] Assignee: Xerox Corporation, Stamford, Conn.

[21] Appl. No.: 146,953

[22] Filed: May 5, 1980

[51] Int. Cl.[3] ..... G03G 13/08; G03G 15/08

[52] U.S. Cl. ..... 430/120; 430/39; 430/125; 118/653; 118/655; 118/651; 355/3 DD; 101/426; 209/129; 290/130

[58] Field of Search ..... 430/39, 102, 103, 120; 118/650, 653, 655; 209/129, 130; 101/426

[56] References Cited

U.S. PATENT DOCUMENTS 3,519,461 7/1970 Stowell ..... 430/125

*Primary Examiner*—John D. Welsh

[57] ABSTRACT

In the development of nonuniform latent images on an imaging member, wherein xerographic polar or polarizable toner particles are employed, it is desirable to utilize a development system that will bring the polar or polarizable toner into contact with the latent image without triboelectrically charging the particles and without requiring magnetic particles when the image is electrostatic and without demagnetizing the image when it is magnetic. To achieve this aim, a dielectric brush having convergent electrostatic fields is disclosed and claimed.

20 Claims, 5 Drawing Figures

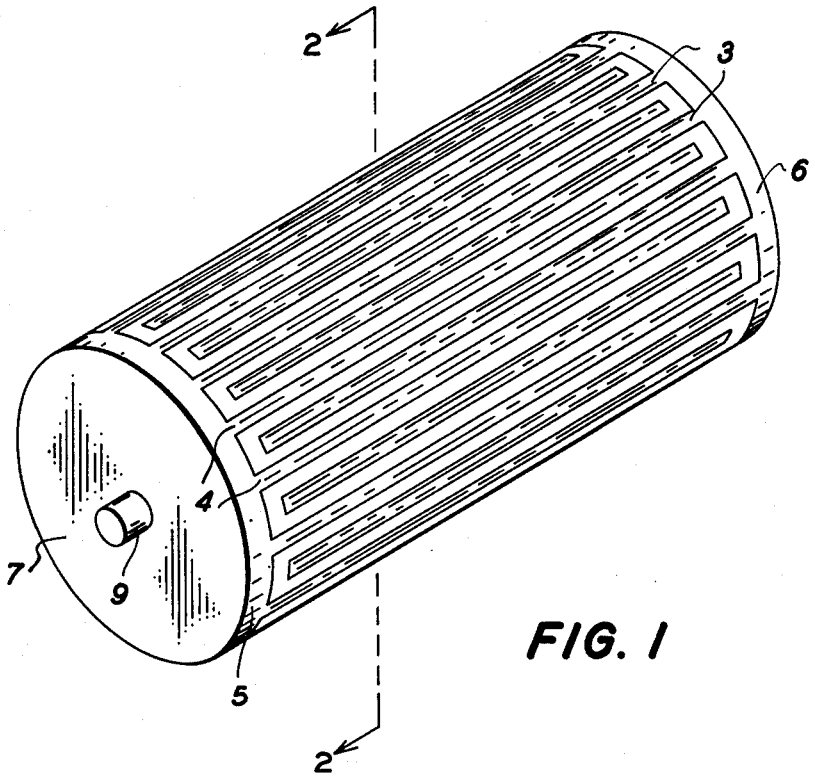
FIG. 1
FIG. 2
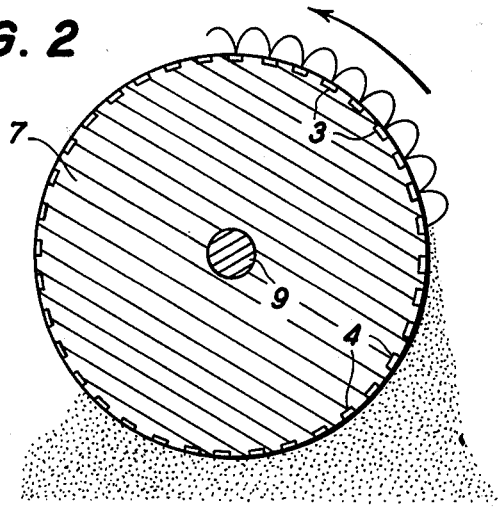

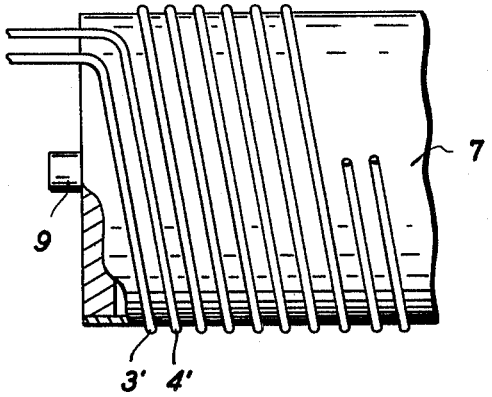
FIG. 3
FIG. 4
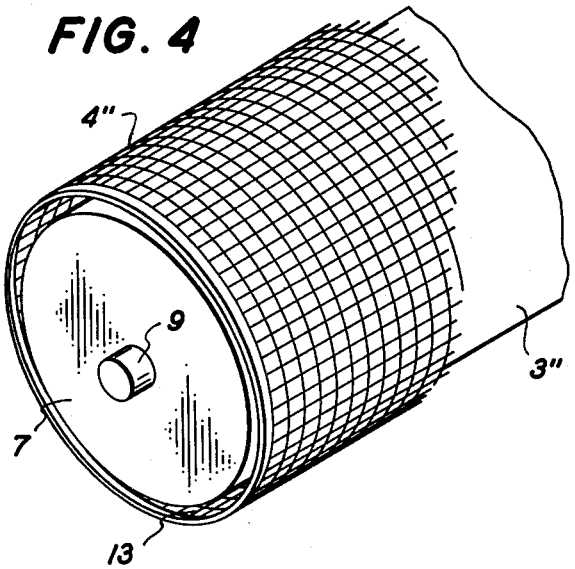

DEVELOPMENT METHOD AND APPARATUS

BACKGROUND OF THE INVENTION

This invention relates to a development apparatus and method and more particularly to an apparatus and method of developing electrostatic or magnetic latent images on an imaging member.

Xerography as originally described in U.S. Pat. No. 2,297,691 to Carlson and later related patents generally includes the steps of charging a photoconductive insulating member to sensitize it and then subjecting the photoconductive member to a light image or other pattern of activating electromagnetic radiation which serves to dissipate charge in radiation struck areas, thus leaving a charge pattern or electrostatic latent image on the photoconductor conforming to the radiation pattern. This radiation pattern is generally referred to as a uniform or a homogeneous charge pattern because there is substantially no potential gradient between small discrete areas where the charge has not been dissipated by exposure to the actinic radiation. Thus, in areas having a uniform charge thereon the lines of force lie within the photoconductive material and do not extend out from the exposed surface of the photoconductive material except at the very edge of an imaging area where a discharged portion of the photoreceptor is adjacent to a charged portion. In this area, the lines of force are present in what has been referred to as a fringe field and extend above the exposed surface of the photoconductive imaging member.

While this uniform charge pattern in unexposed areas was difficult to develop in solid dark image areas, because of the nature of the field present, various techniques were employed. One particularly satisfactory technique uses a development electrode, which permits the development of the solid large areas with the customary development materials, i.e. a two component developer including a carrier material and a toner material. One example of a development electrode to enhance solid area development is U.S. Pat. No. 2,777,418. In these systems the toner is triboelectrically charged by contact with the carrier particles, the charge being opposite in sign to that present on the photoconductive imaging member. A disadvantage of this type of development system is commonly referred to as "the starvation effect" because as large quantities of the toner material are deposited in image configuration the ratio of the toner to the carrier present in the developer mixture changes, thus requiring constant addition of toner to prevent the depletion thereof accompanied by incomplete deposition in the reproduction subsequent in time or downstream in position.

U.S. Pat. Nos. 3,234,017 and 3,519,461 disclose techniques whereby a nonuniform or nonhomogeneous charge pattern in image configuration is produced on an imaging surface wherein small individual, discrete surface elements adjacent to each other within the imaging area are either oppositely charged or some discrete areas are charged and the adjacent areas discharged in order to establish field gradients between adjacent discrete areas, thus permitting the development thereof by utilizing polarizable minute uncharged toner particles. These particles are polarized in the fringe fields protruding above the surface of the imaging member and are thus attracted in image configuration to the imaging member. This system will, because of its nature, develop solid areas without the necessity for development electrodes as indicated above where uniform fields and two component developers are employed. In addition, no starvation effects are present because the developer is 100 percent toner.

Unfortunately, because of the nature of this system, several disadvantages are present which create problems in the handling and development of the latent images using single component uncharged toner particles. The strength of the fringe fields employed, or, more precisely, the forces involved therewith are not as great as those present in electrostatic systems wherein uniform charge patterns are employed and the charges on the particles are a result of triboelectricity. In addition, since the toner particles should remain uncharged to minimize background deposition and in order that they deposit equally in the exiting and entering fringe fields present in the nonuniform charge pattern, care must be taken to prevent charging of the toner particles by contact with materials having a different relative position in the triboelectric series. Thus, a developer delivery system is required that exerts less force on the toner particles than that due to the nonuniform charge pattern in order to prevent removal of toner from desired image portions. Also, any unwanted charging of the toner particles will cause unbalanced deposition of the toner particles in both types of discrete areas present within the charged pattern and will increase unwanted background.

While the advantages relative to the development of nonuniform charge patterns appear to be meritorious, the industry has not developed in this direction, most likely because of the large commercial success of electrostatographic devices employing uniform charge patterns together with dual development systems wherein development electrodes of a various nature have beem employed in order to permit the development of large dark areas. One extremely useful development device where body single component developer, that is, toner alone, and dual development, that is, where a carrier and a toner are employed, is the magnetic brush. These devices are well documented in the patent literature and are currently probably the most widely used means of developing electrostatographic images. Magnetic brushes have also been employed in single component development wherein the toner contains magnetic pigments. It can thus be seen that in such magnetic brush systems either a magnetic carrier material must be present which is also triboelectrically active with respect to the toner particles involved or else the toner particles themselves must be magnetic in order to be employed with a magnetic brush device. This is a serious handicap where reproductions other than black or brown images are desired, since magnetic particles included in the toner particles are extremely dark by nature and make it substantially impossible to develop images in suitable colors other than black or brown.

In addition, magnetic imaging systems exist wherein a magnetic latent image is developed by magnetically attractable toner particles. In these systems, the toner must be presented to the latent image by non-magnetic means, lest the magnetic fields erase the latent image before it can be developed.

Accordingly, it is a primary object of the present invention to provide an improved apparatus and method for developing nonuniform latent images on an imaging surface.

| PRIOR ART STATEMENT | | |
|---|---|---|
| INVENTORS | U.S. PAT. No. | ISSUE DATE |
| Heyl et al | 3,234,017 | February 8, 1966 |
| Stowell | 3,519,461 | July 7, 1970 |
| Raschke | 4,048,921 | September 20, 1977 |
| Bean | 4,103,994 | August 1, 1979 |
| Weiler | 3,999,515 | December 28, 1976 |
| Weiler | 4,017,648 | April 12, 1977 |

Heyl et al U.S. Pat. No. 3,234,107—A non-homogeneous charge pattern is produced by subjecting the photoconductive layer to an electric potential by means of a corona discharge large enough to cause the photoconductive layer to break down electrically at multiple closely spaced discrete locations and depositing uncharged toner to develop the image.

Stowell U.S. Pat. No. 3,519,461—A method of electrostatic printing is disclosed whereby electrical dipoles are established on a dielectric surface and developed with uncharged polarizable toner powder.

Raschke U.S. Pat. No. 4,048,921—An electrostatic charge pattern is established on a dielectric surface and this charge pattern is toned with an insulating fluid containing small particles of high dielectric constant which thereby obtain an induced dipole moment.

Bean U.S. Pat. No. 4,103,994—A recording member is disclosed including a photoconductive layer having embedded therein at least a pair of insulated conductive members. A potential difference is imposed across the pair of conductors to form an electrical field. The imaging member is exposed in image configuration and the latent image developed with uncharged insulating particles using a magnetic development system.

Weiler U.S. Pat. No. 3,999,515—A donor member is described to transport triboelectrically charged toner particles to an electrostatic latent image whereby the latent image is developed by a spaced touchdown development technique. The charged toner particles are maintained in a constant jumping motion by the alternating field induced in the donor.

Weiler U.S. Pat. No. 4,017,648—A microfield donor is provided with means for establishing a plurality of electrostatic microfields on its surface. The polarity of the fields are continuously reversed to alternatively repel and attract toner particles.

SUMMARY OF THE INVENTION

In accordance with this invention there is provided a method and apparatus for developing a nonuniform latent image by establishing a multiplicity of convergent electrical fields on a movable insulating member bearing electrical conductors, directly contacting polar or polarizable toner particles with the movable insulating member and moving the insulating member through a path that brings the toner particles attracted by the convergent electrical fields into close proximity with the nonuniform latent image. The convergent fields hold the toner particles to the insulating member, which is moved so that the toner particles are brought into the vicinity of the nonuniform latent image.

The apparatus and method of this invention is applicable to the development of both nonuniform electrostatic latent images and magnetic latent images. The only requirement being that in the development of magnetic latent images, the toner employed must exhibit paramagnetic properties. That is, the toner particles must be capable of being attracted by a magnet. The technology for the formation of magnetic latent images is known in the art, for example, U.S. Pat. No. 4,138,685 sets forth numerous techniques for the creation thereof. Thus, while the invention will be described hereinafter with respect particularly to electrostatic latent images, it is to be understood that it is equally applicable to the development of magnetic latent images.

The development apparatus includes a movable insulating member supporting an electrode means for establishing on the movable member convergent fields. The convergent fields extend out from the movable member. The electrode means for establishing convergent electrical fields includes at least two electrical conductors disposed on the movable member. The electrical conductors are positioned close to each other such that when a potential difference exists across two adjacent conductors, a convergent electrical field is established. The conductors are shaped such that convergent electrical fields extending out of the movable member exist substantially uniformly over the surface of the movable member. The movable member moves through a path such that the electrical conductors directly contact a source of polar or polarizable toner particles and then carry the toner particles to the latent image. The movable insulating member may be a cylinder that, as it rotates, transports toner from a source thereof to the latent image or it may have any other suitable configuration such as an endless belt. The strength of the field gradients due to the voltage difference applied between the conductors of the electrode means is greatest near the electrical conductors. As the distance from the conductors increases, the force holding the toner particles decreases. When the polarized toner particles are transported into the vicinity of the latent image, the distance between the movable member and the imaging member is fixed such that, the forces on the imaging member attributable to the latent image i.e., the nonuniform charge pattern when the system is electrostatic and the magnetic pattern when the system is magnetic, will accept the toner particles from the movable member. In some instances, the thickness of the toner blanket on the movable member will be controlled by gravity. That is, as the distance away from the member increases, a point will be reached where, because of the forces of gravity, the forces attributable to the convergent fields will be insufficient to hold the particles to the member. It may also be desirable to control the thickness of the toner blanket on the member by utilizing a toner pile height control means such as, a wiping blade, a doctor blade or the like, which will cause the particles above a given height to fall back into the toner sump of the developing device.

In either event, the toner particles are loosely held onto the surface of the member by the convergent fields present thereon due to the voltage differences between the electrical conductors positioned on the movable member. The movable member is generally made of a material which will not create triboelectric charging of the toner particles due to contact therewith. Suitable materials include, for example, polyesters, polystyrenes, polycarbonates, polytetrafluoethylene, and the like. Further, the electrical conductors may be coated with a thin layer of insulating material. This is especially useful for transporting conductive particles.

As indicated, the toner material must be polar or polarizable. That is, in the presence of field gradients the particles must become polarized in order to be subjected to the force due to the field present. Also, where the latent image is a nonuniform electrostatic charge pattern, the particles of toner are attracted thereto because of this characteristic. The toner particles should be of a material having a dielectric constant greater than 2 and a bulk resistivity of at least $10^{11}$ ohm-cm and preferably greater than about $10^{12}$ ohm-cm. Any suitable resinous material having these characteristics and capable of being fixed to the substrate can be employed, such as, for example polyvinyl copolymers, such as, polyvinyl acetate, polyvinyl butyral, and the like; polystyrene and copolymers thereof, polyolefins, such as polyethylene, polypropylene and the like; acrylates such as polymethyl acrylate, polymethyl methacrylate, polymethacrylic acid, copolymers thereof and the like, polycarbonates, polyesters resins, epoxy resins and the like. The toner particles may have any suitable shape including spherical, oval, granular, etc. and have a particle size of from about 5 to about 50 microns, preferably about 10 to about 35 microns and most preferably from about 15 to about 30 microns. When magnetic latent images are being developed, the materials set forth above have included therein magnetically attractable particles such as iron, nickel, oxides and alloys thereof, chromium dioxide, ferrites, magnetite and the like.

BRIEF DESCRIPTION OF THE DRAWINGS

Other aspects of the present invention will become apparent from the following description taken in conjunction with the accompanying drawings, in which:

FIG. 1 is a perspective elevation view of one embodiment of a developer roll in accordance with this invention;

FIG. 2 is a sectional view taken along the lines II—II of FIG. 1 illustrating the lines of force present;

FIG. 3 is a partial schematic view of a second embodiment of a development apparatus in accordance with this invention;

FIG. 4 is a partial perspective view of another embodiment of a development apparatus in accordance with this invention.

Figure 5:
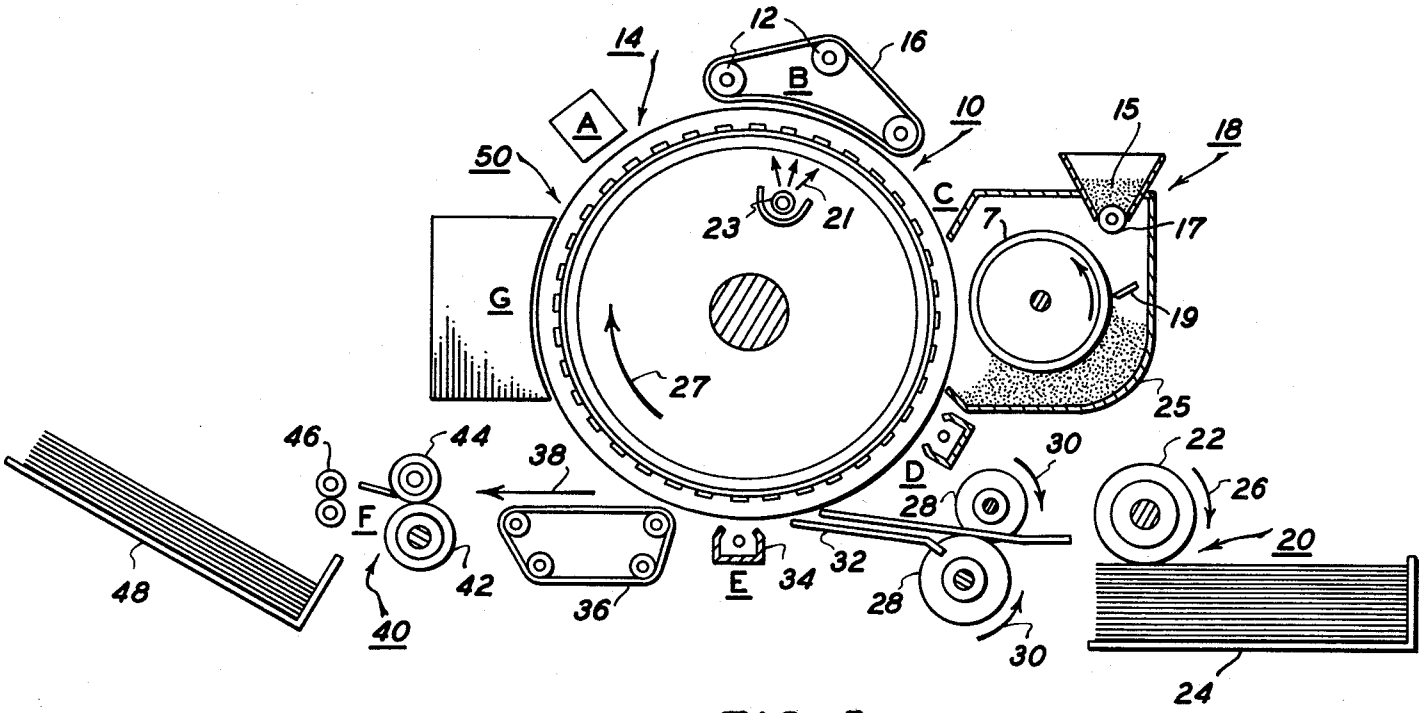
FIG. 5 is a schematic elevation view depicting an electrophotographic printing machine utilizing the method and apparatus of this invention.

While the present invention will hereinafter be described in connection with various embodiments thereof, it will be understood that it is not intended to limit the invention to these embodiments. On the contrary, it is intended to cover all alternatives, modifications and equivalents as may be included within the spirit and the scope of the invention as defined by the appended claims.

DETAILED DESCRIPTION OF THE DRAWINGS

For a general understanding of the features of the present invention, reference is made to the drawings. In the drawings, like reference characters have been used throughout to designate identical elements. FIG. 1 illustrates a developing apparatus in accordance with this invention. The apparatus includes movable insulating member 7 in the form of a cylinder capable of rotation. Disposed on the surface of the cylinder 7 are conductive interdigitated electrodes 3 and 4 which are connected to conductive end portions 5 and 6 respectively. Thus, by connecting end portions to a suitable voltage supply, not shown, alternate electrodes can be biased in order to establish between adjacent electrodes a suitable voltage difference to achieve the convergent field desired. Suitable voltages ranging from a negative 3,000 volts to a positive 3,000 volts may be employed. It may also be desirable to connect one of the conductive end portions to a suitable voltage supply while the other is connected to ground. It is preferred that the voltage difference between adjacent electrodes be at least about 500 volts.

The conductive electrodes 3 and 4 are spaced from each other a distance in order to achieve the optimum thickness of toner on cylinder 7. That is, the distance between the electrodes 3 and 4 will determine, in conjunction with the voltages applied thereto, the distance that the lines of force will extend from the cylinder 7. For example, if the conductive electrodes 3 and 4 are disposed too close to each other the lines of force will primarily be flat in nature substantially bridging the gap between the electrodes by the shortest route possible. Therefore, to achieve a blanket height of toner of about one-eighth of an inch, (0.32 cm) for example, the distance between the electrodes 3 and 4 should be also approximately one-eighth of an inch. It is therefore preferred that the distance between electrodes is from about 0.06 cm to about 0.6 cm and that the ratio of the width of the electrodes to the distance between electrodes varies from about 30:70 to 70:30, preferably 50:50.

As shown in FIG. 1, the cylinder 7 is provided with a suitable shaft 9 which is driven by means (not shown) such as suitable gear means or the like for providing rotation of the cylinder 7. The direction of rotation of the electrode cylinder 7 with respect to the direction of rotation of the imaging member is not critical as both are operative. As the cylinder 7 turns, the toner 11 is caused to polarize by the lines of force 13 shown in FIG. 2. The toner 11 is attracted to the cylinder 7 by the convergent fields and thus moves toward the latent image (See FIG. 5). This is illustrated in FIG. 2 wherein the direction of rotation of the cylinder 7 is shown by the arrow. FIG. 2 also illustrates the lines of force 13 of the fields created by the potential difference between adjacent conductive electrodes 3 and 4. Also illustrated is the blanket of toner particles which will extend approximately in equal lengths above the surface of the cylinder 8 as that of the force lines. The toner 11 moves in the same direction as cylinder 7. As cylinder 7 rotates, a portion of the toner particles will drop from the surface thereof because of gravity.

FIG. 3 is another embodiment of an electrode structure for establishing convergent fields around the surface of the movable insulating member 7. In this Figure, insulating cylinder 7 has disposed on the surface thereof helical conductors 3' and 4' each of which is connected to a suitable voltage supply to create a voltage difference between the conductors and establish the convergent field desired. The cylinder 7 is positioned in a suitable copying apparatus near the imaging member. In this embodiment, the electrodes 3' and 4' may be formed by cutting helical grooves in an insulating cylinder and winding wires therein or filling the grooves with any suitable conducting material such as conductive metals, conductive polymers or the like. Further, the electrode pattern may be deposited on the surface by any suitable technique including those employing photolithography, electroplating, evaporating and the like. The preferred dimensions indicated above with respect to FIG. 1 are equally applicable to this embodiment.

FIG. 4 is a third embodiment of an electrode design for establishing a convergent field around the outer surface of the insulating member 7. In this embodiment, cylinder 7 has a conductive surface which acts as electrode 3''. Adjacent this conductive surface 3'' is an insulating space 13, electrically separating surface 3'' from grid electrode 4''. In FIG. 4, insulating space 13 is shown as an air gap, however, it may be a layer of any suitable insulating material. Grid electrode 4'' has an open area of at least 50% and preferably greater than 90% to thereby permit the field to extend radially outward. As in the first two embodiments, the distance between centers of adjacent wires of the grid should be such as to permit the field to extend as far as possible.

FIG. 5 schematically depicts the various components of an illustrative electrophotographic printing machine incorporating the present invention. It will become evident from the following discussion that the method and apparatus of this invention described hereinafter is equally well suited for use in a wide variety of electrostatographic and magnetic printing machines and is not necessarily limited in its application to the particular embodiment shown herein.

Inasmuch as the art of electrophotographic printing is well known, the various processing stations employed in FIG. 5 are shown schematically and their operation described briefly with reference thereto.

As shown in FIG. 5, the electrophotographic printing machine employs a transparent or semi-transparent drum, indicated generally by the reference numeral 10. Drum 10 has the cross-sectional configuration such that reflex exposure of the photoconductive layer takes place to achieve a nonuniform charge pattern. Drum 10 rotates in the direction of arrow 27 to pass through the various processing stations disposed thereabout.

Initially, drum 10 moves a portion of the imaging member 11 through charging station A. At charging station A, a corona generating device, indicated generally by the reference numeral 14, charges the photoconductive surface of drum 10 to a relatively high, substantially uniform potential.

Thereafter, the charged portion of the photoconductive surface of drum 10 is advanced through exposure station B. At exposure station B, an original document is positioned face-down upon the drum 10 by means of rollers 12 and continuous belt 16. At least one of the rollers 12 is driven by a motor not shown. It is to be understood that both the drum 10 and the belt 16 can be driven either continuously or in step fashion depending upon the design characteristics and logic of the particular device. The exposure station B includes a lamp 23 disposed within the drum 10. The light rays 21, pass through the imaging member and are reflected from the original document, discharging the photoreceptive layer of drum 10 in image configuration to establish on the drum 10 a periodic charge pattern in the image areas.

While the exposure station B is illustrated as a reflex exposure means as set forth in U.S. application Ser. No. 135,421, filed Mar. 31, 1980 by Robert W. Gundlach and assigned to the assignee of this application, it is to be understood that any suitable imaging member and method of obtaining a nonuniform charge pattern thereon may be used. For example, the imaging member may be an insulating surface or a photoconductive surface as used in conventional xerography such as, for example, selenium and alloys thereof, polyvinylcarbazole-trinitrofluorenone and the like. When an insulating imaging member is employed, the nonuniform charge pattern in image configuration may be deposited thereon by use of styli, by corona charging through a screened stencil, and the like. When a photoreceptor material is employed, the pattern may be formed in the same manner as the insulator, or a corona source can first charge the photoreceptor over the entire surface with a periodic pattern and then exposed in typical fashion through a lens system. Also, the photoreceptor may be uniformly charged and exposed through a screen or grid pattern. Further, any of the techniques disclosed in the references set forth hereinbefore in the prior art section for the formation of a nonuniform charge pattern on an imaging member may be employed.

Next, drum 10 advances the nonuniform electrostatic latent image recorded on the photoconductive surface to development station C. At development station C, development system, indicated generally by the reference numeral 18, transports a polar or polarizable toner material into contact with the photoconductive surface of drum 10. The developer material, or a portion thereof, is attracted to the periodic charge pattern latent image, forming a toner powder image corresponding to the informational areas of the original document. The development system 18 includes a housing 25 which provides a toner sump, a hopper 15 having a dispensing means 17 and the development roll shown and described with respect to FIGS. 1-4. Doctor blade 19 maintains the thickness of the toner blanket 11 shown in FIG. 2 at a constant thickness. The cylinder 7 as shown rotates clockwise, and the toner is picked up thereby and moved toward and in the same direction as the photoconductor within the development zone.

Continuing now with the various processing stations disposed in the electrophotographic printing machine, after the powder image is deposited on the photoconductive surface, drum 10 advances the powder image to corona charging station D and from there to transfer station E. The polarity of charge applied to the developed image at station D is not critical, although it is preferred to use charge of the same polarity as the charge applied to sensitize the photoreceptor.

At transfer station E, a sheet of support material (paper) is positioned in contact with the powder image formed on the photoconductive surface of drum 10. The sheet of support material is advanced to the transfer station by a sheet feeding apparatus, indicated generally by the reference numeral 20. Preferably, sheet feeding apparatus 20 includes a feed roll 22 contacting the uppermost sheet of the stack 24 of the sheets of support material. Feed roll 22 rotates in the direction of arrow 26 so as to advance the uppermost sheet from stack 24. Registration rollers 28, rotating in the direction of arrow 30, align and forward the advancing sheet of support material into chute 32. Chute 32 directs the advancing sheet of support material into contact with the photoconductive surface of drum 10 in a timed sequence. This insures that the powder image contacts the advancing sheet of support material at transfer station E.

Transfer station E includes a corona generating device 34, which applies a spray of ions opposite in polarity to the corona charge applied to the toner at pretransfer station D, to the backside of the sheet. This attracts the powder image from the photoconductive surface of drum 10 to the sheet. After transfer, the sheet continues to move with drum 10 and is separated therefrom by a detack corona generating device (not shown) which reduces the charge causing the sheet to adhere to the drum. Conveyor 36 advances the sheet, in the direction of arrow 38, from transfer station E to fusing station F.

Fusing station F, indicated generally by the reference numeral 40, includes a back-up roller 42 and a heated fuser roller 44. The sheet of support material with the powder image thereon, passes between back-up roller 42 and fuser roller 44. The powder image contacts fuser roller 44 and the heat and pressure applied thereto permanently bonds it to the sheet of support material. Although a heated pressure system has been described for permanently affixing the particles to a sheet of support material, a cold pressure system may be utilized in lieu thereof. The particular type of fusing system employed depends upon the type of particles being utilized in the development system. After fusing, forwarding rollers 46 advance the finished copy sheet to catch tray 48. Once the copy sheet is positioned in catch tray 48, it may be removed therefrom by the machine operator.

Invariably, after the sheet of support material is separated from the photoconductive surface of drum 10, some residual particles remain adhering thereto. These residual particles are cleaned from drum 10 at cleaning station G. Cleaning station G includes a cleaning mechanism 50 which may comprise a preclean corona generating device and a rotatably mounted fiberous brush in contact with the photoconductive surface of drum 10. The preclean corona generating device neutralizes the charge attracting the particles to the photoconductive surface. The particles are then cleaned from the photoconductive surface by the rotation of the brush in contact therewith. Subsequent to cleaning, a discharge lamp floods the photoconductive surface with light to dissipate any residual charge remaining thereon prior to the charging thereof for the next successive imaging cycle.

It is believed that the foregoing description is sufficient for purposes of the present invention to illustrate the general operation of an electrophotographic printing machine incorporating the features of the present invention therein.

While this invention has been described herein in considerable detail, it is to be understood that various modifications will become apparent to those skilled in the art. Accordingly, it is intended to embrace all such modifications within the spirit and scope of the appended claims.

What is claimed is:

1. In an apparatus employing polar or polarizable toner particles for the development of a nonuniform electrostatic or magnetic latent image, a development means comprising a movable insulating member disposed in close proximity to said latent image, said member supporting an electrode means for establishing on the member convergent fields extending out from said member, said member being disposed to directly contact a source of said polar or polarizable toner particles in a first location and transport said particles to said nonuniform latent image in a second location.

2. The apparatus of claim 1 wherein the movable member of said development means is a rotatable cylinder bearing closely spaced electrode means on the surface thereof for establishing said convergent fields.

3. The apparatus of claim 2 wherein the electrode means comprises a first electrically conductive member disposed in spaced relation to a second electrically conductive member, said first electrically conductive member being electrically biased with respect to said second electrically conductive member.

4. The apparatus of claim 3 wherein the electrode means for establishing convergent fields on the surface of said movable member comprises axially aligned, interdigitated electrodes, alternate members of which are connected together.

5. The apparatus of claim 2 wherein the electrode means for establishing convergent fields around the outer surface of the rotatable cylinder comprises first and second concentric cylindrical electrodes, said first electrode being disposed within said second electrode, said second electrode being a screen having an open area of at least about 50%, the distance between said first electrode and said second electrode being substantially equal to the distance between centers of adjacent conductors of said screen.

6. The apparatus of claim 2 wherein the electrode means for establishing convergent fields around the outer surface of the rotatable cylinder is a pair of conductors in the form of a helix, each conductor being connected to a separate voltage source.

7. The apparatus of claim 1 wherein the nonuniform latent image is an electrostatic image.

8. The apparatus of claim 1 wherein the nonuniform latent image is a magnetic image.

9. The apparatus of claim 4 wherein the distance between conductive members is from about 0.06 cm to about 0.6 cm.

10. The apparatus of claim 4 wherein the ratio of the width of the electrodes to the distance between electrodes of said array varies from about 30:70 to about 70:30.

11. The apparatus of claim 1 wherein the pile height of polarized toner on the movable member is controlled by a member disposed in spaced relation with said member.

12. The apparatus of claim 11 wherein the member for controlling the toner pile height is a doctor blade.

13. The apparatus of claim 1 wherein the electrode means is coated with an insulating coating.

14. A method of developing a nonuniform electrostatic or magnetic latent image on an imaging member which comprises, establishing a multiplicity of convergent electrical fields on a movable insulating member bearing electrical conductors, directly contacting a source of polar or polarizable toner particles with the insulating member and moving the insulating member through a path that brings the toner particles attracted by the convergent electrical fields into close proximity with the nonuniform latent image, said toner particles exhibiting paramagnetic properties when said nonuniform latent image is magnetic.

15. The method of claim 14 wherein said multiplicity of convergent electrical fields are established by voltage differences applied between closely spaced adjacently positioned electrical conductors.

16. The method of developing a nonuniform latent image in accordance with claim 14 wherein the latent image is a magnetic image.

17. The method of developing a nonuniform latent image in accordance with claim 14 wherein the latent image is an electrostatic image.

18. An apparatus for making a copy of an original document comprising a means for imparting to an imaging member a nonuniform electrostatic or magnetic latent image, a development means for rendering visible said latent image, said development means comprising a movable insulating member disposed in close proximity to said latent image, said member supporting an electrode means for establishing on the member convergent fields extending out from said member, said member being disposed to directly contact a source of said polar or polarizable toner particles in a first location and transport said particles to said nonuniform latent image in a second location, a transfer means to transfer the toner in image configuration to a support member, a means for fixing the toner to the support member, and a means for cleaning the imaging member.

19. The apparatus of claim 18 wherein the nonuniform latent image is an electrostatic latent image.

20. The apparatus of claim 18 wherein the nonuniform latent image is a magnetic latent image.

* * * * *